US005864972A

United States Patent [19]

Gamache

[11] Patent Number: 5,864,972

[45] Date of Patent: Feb. 2, 1999

[54] GRAVESITE COVERING SYSTEM

[76] Inventor: Roger Gamache, 93 Congress St. P.O. Box 804, Cohoes, N.Y. 12047

[21] Appl. No.: 846,541

[22] Filed: Apr. 29, 1997

[51] Int. Cl.[6] ..... G09F 1/10

[52] U.S. Cl. ..... 40/124.5; 40/124.2; 52/4; 52/DIG. 14

[58] Field of Search ..... 52/3, 4, 103, 104, 52/DIG. 14; 206/83.5, 315.5, 315.4; 150/154, 159, 164, 165; 135/95, 96, 124; 40/124.2, 124.5

[56] References Cited

U.S. PATENT DOCUMENTS 4,453,632 6/1984 Clower ..... 206/315.4
5,220,950 6/1993 Cordasco ..... 150/159

FOREIGN PATENT DOCUMENTS 9329 8/1915 United Kingdom .
390429 4/1933 United Kingdom .

*Primary Examiner*—Michael Safavi

[57] ABSTRACT

A gravesite covering system for protecting and decorating gravesites and gravestones. The device includes a first member made from a flexible, transparent plastic sheet material. The first member has a main body portion shaped for disposal over a gravestone, and a skirt portion for anchoring the first member to the ground around the gravestone using spikes extending through grommets in the skirt portion. A planar, rectangular member made from a flexible, transparent plastic sheet material is secured along one edge thereof to the first member for covering the ground in front of the gravestone. The rectangular member also includes grommets therein for anchoring the rectangular member to the ground. The first member and the rectangular member each include a pocket for holding a picture of the deceased therein, and are provided with ornamentation for making the gravesite more attractive. The members can also be separately used if only a portion of the gravesite is to be protected and decorated.

12 Claims, 2 Drawing Sheets

GRAVESITE COVERING SYSTEM

BACKGROUND OF THE INVENTION

1. Field of the Invention

The present invention relates to gravesites and gravestones and more particularly pertains to a new gravesite covering system for protecting and decorating gravesites and gravestones.

2. Description of the Prior Art

The use of gravesites and gravestones is known in the prior art. More specifically, gravesites and gravestones heretofore devised and utilized are known to consist basically of familiar, expected and obvious structural configurations, notwithstanding the myriad of designs encompassed by the crowded prior art which have been developed for the fulfillment of countless objectives and requirements.

Known prior art gravesites and gravestones include U.S. Pat. No. 4,304,076; U.S. Pat. No. 4,058,940; Des. U.S. Pat. No. 297,478; Des. U.S. Pat. No. 359,151; and U.S. Pat. No. 4,428,168. Additionally, U.S. Pat. No. 5,009,033 teaches a ground covering sheet.

While these devices fulfill their respective, particular objectives and requirements, the aforementioned patents do not disclose a new gravesite covering system. The inventive system includes a first member made from a flexible, transparent plastic sheet material. The first member has a main body portion shaped for disposal over a gravestone, and a skirt portion for anchoring the first member to the ground around the gravestone using spikes extending through grommets in the skirt portion. A planar, rectangular member made from a flexible, transparent plastic sheet material is secured along one edge thereof to the first member for covering the ground in front of the gravestone. The rectangular member also includes grommets therein for anchoring the rectangular member to the ground. The first member and the rectangular member each include a pocket for holding a picture of the deceased therein, and are provided with ornamentation for making the gravesite more attractive. The members can also be separately used if only a portion of the gravesite is to be protected and decorated.

In these respects, the gravesite covering system according to the present invention substantially departs from the conventional concepts and designs of the prior art, and in so doing provides an apparatus primarily developed for the purpose of protecting and decorating gravesites and gravestones.

SUMMARY OF THE INVENTION

In view of the foregoing disadvantages inherent in the known types of gravesites and gravestones now present in the prior art, the present invention provides a new gravesite covering system wherein the same can be utilized for protecting and decorating gravesites and gravestones.

The general purpose of the present invention, which will be described subsequently in greater detail, is to provide a new gravesite covering system which has many of the advantages of the gravesites and gravestones mentioned heretofore and many novel features that result in a new gravesite covering system which is not anticipated, rendered obvious, suggested, or even implied by any of the prior art gravesites and gravestones, either alone or in any combination thereof.

To attain this, the present invention generally comprises a first member made from a flexible, transparent plastic sheet material. The first member has a main body portion shaped for disposal over a gravestone, and a skirt portion for anchoring the first member to the ground around the gravestone using spikes extending through grommets in the skirt portion. A planar, rectangular member made from a flexible, transparent plastic sheet material is secured along one edge thereof to the first member for covering the ground in front of the gravestone. The rectangular member also includes grommets therein for anchoring the rectangular member to the ground. The first member and the rectangular member each include a pocket for holding a picture of the deceased therein, and are provided with ornamentation for making the gravesite more attractive. The members can also be separately used if only a portion of the gravesite is to be protected and decorated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new gravesite covering system which has many of the advantages of the gravesites and gravestones mentioned heretofore and many novel features that result in a new gravesite covering system which is not anticipated, rendered obvious, suggested, or even implied by any of the prior art gravesites and gravestones, either alone or in any combination thereof.

It is another object of the present invention to provide a new gravesite covering system which may be easily and efficiently manufactured and marketed.

It is a further object of the present invention to provide a new gravesite covering system which is of a durable and reliable construction.

An even further object of the present invention is to provide a new gravesite covering system which is susceptible of a low cost of manufacture with regard to both materials and labor, and which accordingly is then susceptible of low prices of sale to the consuming public, thereby making such gravesite covering system economically available to the buying public.

Still yet another object of the present invention is to provide a new gravesite covering system which provides in the apparatuses and methods of the prior art some of the advantages thereof, while simultaneously overcoming some of the disadvantages normally associated therewith.

Still another object of the present invention is to provide a new gravesite covering system for protecting and decorating gravesites and gravestones.

Yet another object of the present invention is to provide a new gravesite covering system which includes a first member made from a flexible, transparent plastic sheet material. The first member has a main body portion shaped for disposal over a gravestone, and a skirt portion for anchoring the first member to the ground around the gravestone using spikes extending through grommets in the skirt portion. A planar, rectangular member made from a flexible, transparent plastic sheet material is secured along one edge thereof to the first member for covering the ground in front of the gravestone. The rectangular member also includes grommets therein for anchoring the rectangular member to the ground. The first member and the rectangular member each include a pocket for holding a picture of the deceased therein, and are provided with ornamentation for making the gravesite more attractive. The members can also be separately used if only a portion of the gravesite is to be protected and decorated.

Still yet another object of the present invention is to provide a new gravesite covering system that can be rolled up for easy storage when not in use, and which can be reused thus saving money.

Even still another object of the present invention is to provide a new gravesite covering system that protects gravestones from environmental damage, so that wearing and clouding of the stone is reduced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
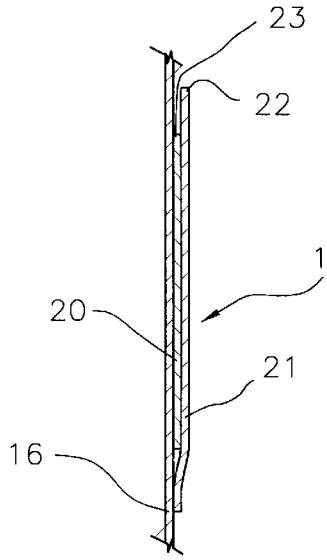
FIG. 3 is a cross sectional view taken along line 3—3 of FIG. 1.

With reference now to the drawings, and in particular to FIGS. 1 through 4 thereof, a new gravesite covering system embodying the principles and concepts of the present invention and generally designated by the reference numeral 10 will be described.

As best illustrated in FIGS. 1 through 4, the gravesite covering system 10 comprises a covering member 11 for a gravestone 12, and a covering member 13 for the ground in front of the gravestone.

Figure 1:
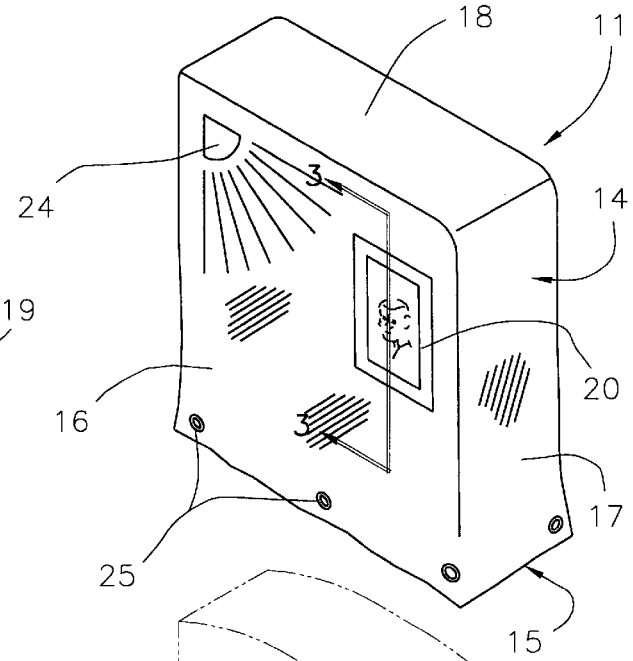
FIG. 1 is an elevated perspective view of the gravestone covering member removed from the gravestone, which is illustrated in dashed lines.
Figure 1:
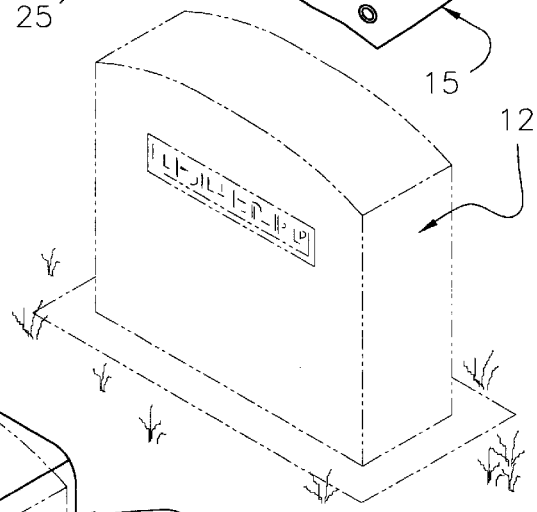
Figure 2:
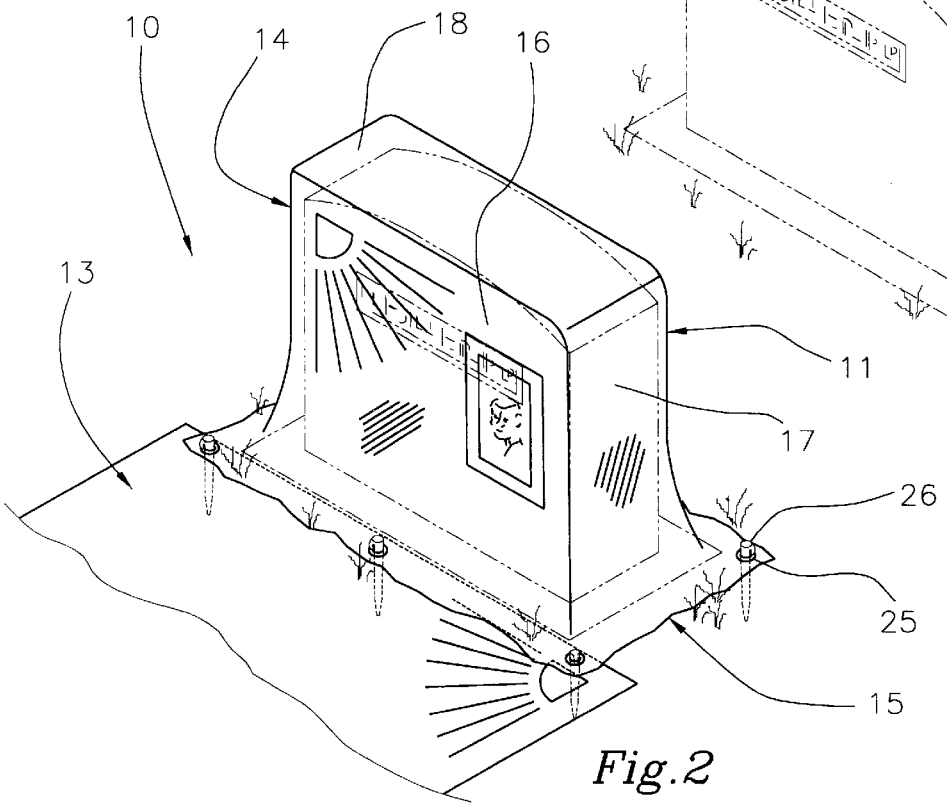
FIG. 2 is an elevated perspective view of the gravestone covering member disposed over the gravestone, with a portion of the rectangular ground covering member shown attached to the gravestone covering member.

The covering member 11 is made from a flexible, transparent plastic sheet material, and is shaped similarly to the gravestone that it is intended to cover so that it fits loosely thereover. As best shown in FIGS. 1 and 2, the member 11 includes a vertically oriented main body portion 14 and a skirt portion 15 at the base of the main body portion. The portion 14 is defined by front and rear end panels 16 (only one being visible in the figures) for covering the front and rear, respectively, of the gravestone. Side panels 17 (only one being visible) extend between the end panels for covering the sides of the gravestone 12, while a top panel 18 extends between the end panels and the side panels for covering the top of the gravestone.

A pocket 19 is formed on the side of the front panel 16 which faces the front of the gravestone, as shown in FIG. 3, for holding a picture 20 of the deceased or other material. The pocket 19 is formed by a rectangular panel 21 which is secured along three edges thereof to the panel 16, thus leaving one unsecured edge 22 which forms a slot 23 with the front panel through which the picture 20 can be inserted and removed. The edges of the panel 21 can be secured in any suitable manner, such as with an adhesive or by molding the panel 21 integrally with the panel 16. Since the picture 20 is on the backside of the front panel 16, it is protected against rain, snow, and the like.

The front end panel 16, and if desired any of the other panels, include ornamentation thereon, such as a depiction of the sun 24, a cross, or any other appropriate design, in order to add a decorative effect to the covering member 11.

The skirt portion 15 integrally extends from the base of the main body portion 14 such that it is disposed over the ground surrounding the base of the gravestone 12. A plurality of grommets 25 are provided at spaced locations around the skirt portion for permitting anchoring of the skirt portion to the ground using spikes 26 or the like, extending through the grommets and into the ground. The grommets 25 can be either metal or rubber.

The ground covering member 13 is also made from a flexible, transparent plastic sheet material, preferably the same material used to form the member 11, although a different plastic could be used if desired. The member 13 is generally planar and rectangular in shape, and includes a pocket identical to the pocket 19 on the side of the member 13 which faces the ground for holding a picture 27 of the deceased or other material. The member 13 also includes ornamentation thereon which can be the same as, or different from, the ornamentation on the member 11, such as a depiction of the sun 28. The member 13 is preferably sized such that it covers the entire ground above the grave, and it could be sized to simultaneously cover adjacent graves as well.

Figure 4:
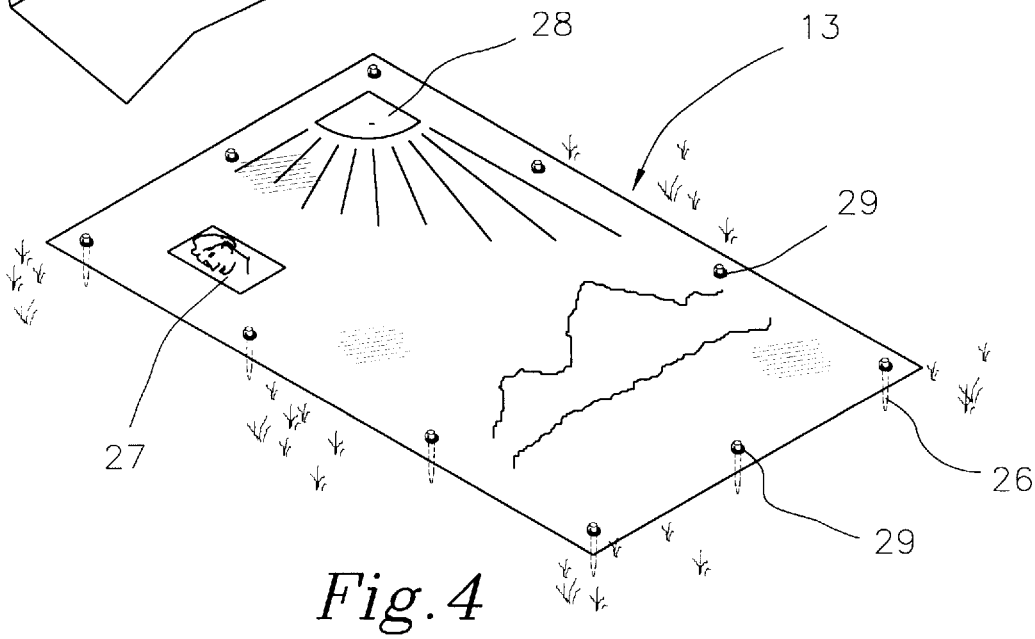
FIG. 4 is an elevated perspective view of the rectangular ground covering member.

As best shown in FIG. 4, the member 13 includes a plurality of rubber or metal grommets 29 spaced about the edges thereof such that the member 13 can be anchored to the ground using the spikes 26 or the like. The grommets 29 along one end of the member 13 have a spacing similar to the spacing of the grommets 25 on the front side of the skirt 15, such that when the end of the member 13 is disposed either under or over the front end of the skirt, the grommets 25,29 can be aligned and the spikes 26 inserted through the aligned grommets, such that the spikes 26 secure the members 11,13 together as well as perform an anchoring function.

The members 11,13 are preferably used together to cover both the gravestone and the ground in front of the gravestone, with the members being anchored in place using the spikes 26 inserted through the grommets 25,29. However, the members 11,13 could also be used separately to cover only individual portions of the gravesite. When not in use, the flexible nature of the members 11,13 allows them to be rolled up and stored in suitable containers for later use.

Figure 5:
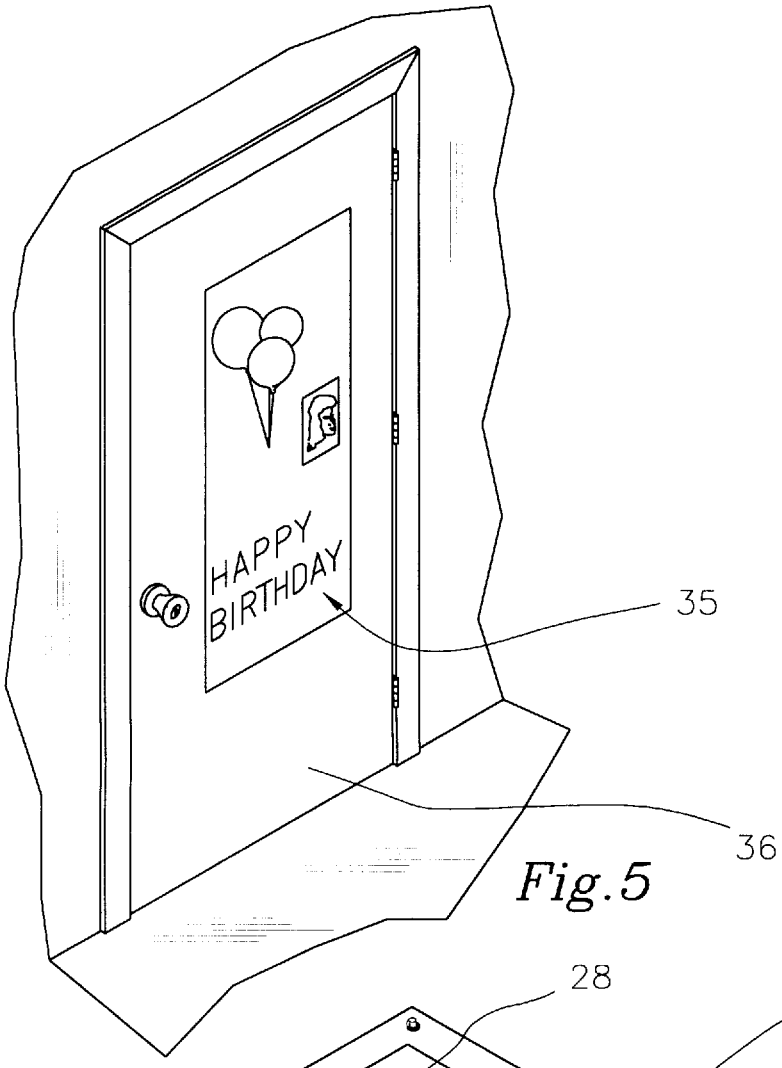
FIG. 5 is a view illustrating an additional use of a rectangular sheet cover.

FIG. 5 illustrates an embodiment where a planar, rectangular cover member 35 is used to cover a door 36. The member 35 is made of a flexible, transparent plastic sheet material, and is provided with a pocket on the back side thereof which is identical to the pockets on the members 11,13. The member also includes ornamentation and indicia thereon for decorating the door. The member is preferably attached to the door using a removable adhesive so that the member 35 can be easily detached from the door and reused if desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A covering system for a gravesite, comprising:

a member made from a flexible, transparent sheet material and adapted for disposal over a gravestone at the gravesite;

pocket means formed on the member for retaining a picture therein, said pocket means comprising a panel having outer perimeter edges secured to an interior surface of said member such that a picture inserted in said pocket means is displayed adjacent the gravestone through the member; and means for anchoring the member to the ground.

2. The covering system according to claim 1, wherein said member comprises a vertically oriented main body portion and a skirt portion extending from a base of the main body portion, said anchoring means being formed in, and extending through, said skirt portion.

3. A covering system for a gravesite, comprising:

a member made from a flexible, transparent sheet material and adapted for disposal over a gravestone at the gravesite:

pocket means formed on the member for retaining a picture therein:

means for anchoring the member to the ground:

wherein said member comprises a vertically oriented main body portion and a skirt portion extending from a base of the main body portion, said anchoring means being formed in, and extending through, said skirt portion; and wherein said anchoring means comprises a plurality of grommets on the skirt portion and spaced thereabout, and a spike extending through each of said grommets.

4. The covering system according to claim 3, wherein said main body portion comprises a pair of end panels, a pair of side panels extending between the end panels, and a top panel extending between the end panels and the side panels.

5. The covering system according to claim 4, wherein said pocket means is formed on one of said end panels on a side thereof which is disposed adjacent the gravestone when the member is disposed thereover.

6. The covering system according to claim 5, wherein said pocket means comprises a rectangular panel secured along three edges thereof to the one end panel, said rectangular panel having one unsecured edge so as to define a slot between the unsecured edge and the one end panel through which the picture can be inserted and removed.

7. The covering system according to claim 3, further comprising a planar, rectangular member made from a flexible, transparent plastic sheet material and having one edge thereof removably attached to the skirt portion for covering the ground in front of the gravestone.

8. The covering system according to claim 7, wherein the one edge of the rectangular member includes a plurality of grommets therein which are aligned with a corresponding plurality of the grommets in the skirt portion, and said spikes extend through the aligned grommets.

9. The covering system according to claim 8, wherein said rectangular member includes additional grommets spaced thereabout for facilitating securement of the rectangular member to the ground.

10. The covering system of claim 7, wherein said rectangular member includes an additional pocket formed on a side thereof which faces the ground for holding a picture, said additional pocket comprising a rectangular panel secured along three edges thereof to the ground facing side of the member, said rectangular panel having one unsecured edge so as to define a slot between the unsecured edge and the ground facing side through which the picture can be inserted and removed.

11. The covering system according to claim 7, further including ornamentation on the gravestone member and the planar, rectangular member.

12. A covering system for a gravesite, comprising:

a member made from a flexible, transparent sheet material and adapted for disposal over a gravestone at the gravesite;

pocket means formed on the member for retaining a picture therein;

means for anchoring the member to the ground;

wherein said member comprises a vertically oriented main body portion and a skirt portion extending from a base of the main body portion, said anchoring means being formed in, and extending through, said skirt portion;

wherein said anchoring means comprises a plurality of grommets on the skirt portion and spaced thereabout, and a spike extending through each of said grommets;

wherein said main body portion comprises a pair of end panels, a pair of side panels extending between the end panels, and a top panel extending between the end panels and the side panels;

wherein said pocket means is formed on one of said end panels on a side thereof which is disposed adjacent the gravestone when the member is disposed thereover;

wherein said pocket means comprises a rectangular panel secured along three edges thereof to the one end panel, said rectangular panel having one unsecured edge so as to define a slot between the unsecured edge and the one end panel through which the picture can be inserted and removed;

a planar, rectangular member made from a flexible, transparent plastic sheet material and having one edge thereof removably attached to the skirt portion for covering the ground in front of the gravestone;

wherein the one edge of the rectangular member includes a plurality of grommets therein which are aligned with a corresponding plurality of the grommets in the skirt portion, and said spikes extend through the aligned grommets;

wherein said rectangular member includes additional grommets spaced thereabout for facilitating securement of the rectangular member to the ground;

wherein said rectangular member includes an additional pocket formed on a side thereof which faces the ground for holding a picture, said additional pocket comprising a rectangular panel secured along three edges thereof to the ground facing side of the member, said rectangular panel having one unsecured edge so as to define a slot between the unsecured edge and the ground facing side through which the picture can be inserted and removed; and ornamentation on the gravestone member and the planar, rectangular member.

* * * * *